US008066149B2

(12) United States Patent
Strange et al.

(10) Patent No.: US 8,066,149 B2
(45) Date of Patent: Nov. 29, 2011

(54) STACKABLE CONTAINER WITH SUPPORT STRUCTURE

(75) Inventors: Randall Glenn Strange, Manteca, CA (US); Richard L. Bontrager, Ripon, CA (US)

(73) Assignee: Packing Plus, LLC, La Mirada, CA (US)

( * ) Notice: Subject to any disclaimer, the term of this patent is extended or adjusted under 35 U.S.C. 154(b) by 768 days.

(21) Appl. No.: 12/107,453

(22) Filed: Apr. 22, 2008

(65) Prior Publication Data

US 2009/0014348 A1 Jan. 15, 2009

Related U.S. Application Data

(60) Provisional application No. 60/913,485, filed on Apr. 23, 2007.

(51) Int. Cl.

| | |
|---|---|
| ***B65D 41/16*** | (2006.01) |
| ***B65D 6/28*** | (2006.01) |
| ***B65D 85/62*** | (2006.01) |

(52) U.S. Cl. ..... 220/782; 206/508; 220/4.21

(58) Field of Classification Search ..... 220/671, 220/4.21, 608, 670, 623, 628, 604–606, 555; 206/508, 509, 511

See application file for complete search history.

(56) References Cited

U.S. PATENT DOCUMENTS

| | | | | |
|---|---|---|---|---|
| 4,593,816 | A * | 6/1986 | Langenbeck | 206/425 |
| 5,456,379 | A * | 10/1995 | Krupa et al. | 220/835 |
| 5,860,549 | A * | 1/1999 | Allers et al. | 220/4.23 |

* cited by examiner

*Primary Examiner* — Robin Hylton
(74) *Attorney, Agent, or Firm* — Fliesler Meyer LLP

(57) ABSTRACT

A container for holding goods comprises a basket having a base and a sidewall, a lid mateable with the basket, and a support structure. The support structure includes a pillar extending between the base and the lid and a tie connected between the pillar and the sidewall.

17 Claims, 4 Drawing Sheets

STACKABLE CONTAINER WITH SUPPORT STRUCTURE

CLAIM OF PRIORITY

This application claims priority to U.S. Provisional Patent Application No. 60/913,485, entitled "STACKABLE CONTAINER WITH SUPPORT STRUCTURE," filed on Apr. 23, 2007.

TECHNICAL FIELD

This invention relates generally to packaging, and more particularly to packaging for fragile and/or perishable goods.

BACKGROUND

Plastic berry baskets are ubiquitous in grocery stores and produce markets and can be found by consumers in a variety of shapes and sizes. For example, raspberries and blackberries and the like are sold in clear polyethylene terephthalate (PETE) clamshell containers holding anywhere from a half-pint to a quart or more of fruit. Despite availability in myriad shapes and sizes, such plastic berry baskets are commonly designed for consumer level use. Produce sold in bulk bins, such as lettuce, melons and the like, are commonly delivered to markets, restaurants and other bulk customers in bags or small tubs that are placed in corrugated cardboard, which is then placed on pallets and shrink-wrapped. There is a need for a container that can provide benefits to bulk customers in the form of one or more of reducing an amount of packaging, reducing an amount of damage to transported goods, and increasing reusability of packaging.

DETAILED DESCRIPTION OF THE DRAWINGS

Figure 1:
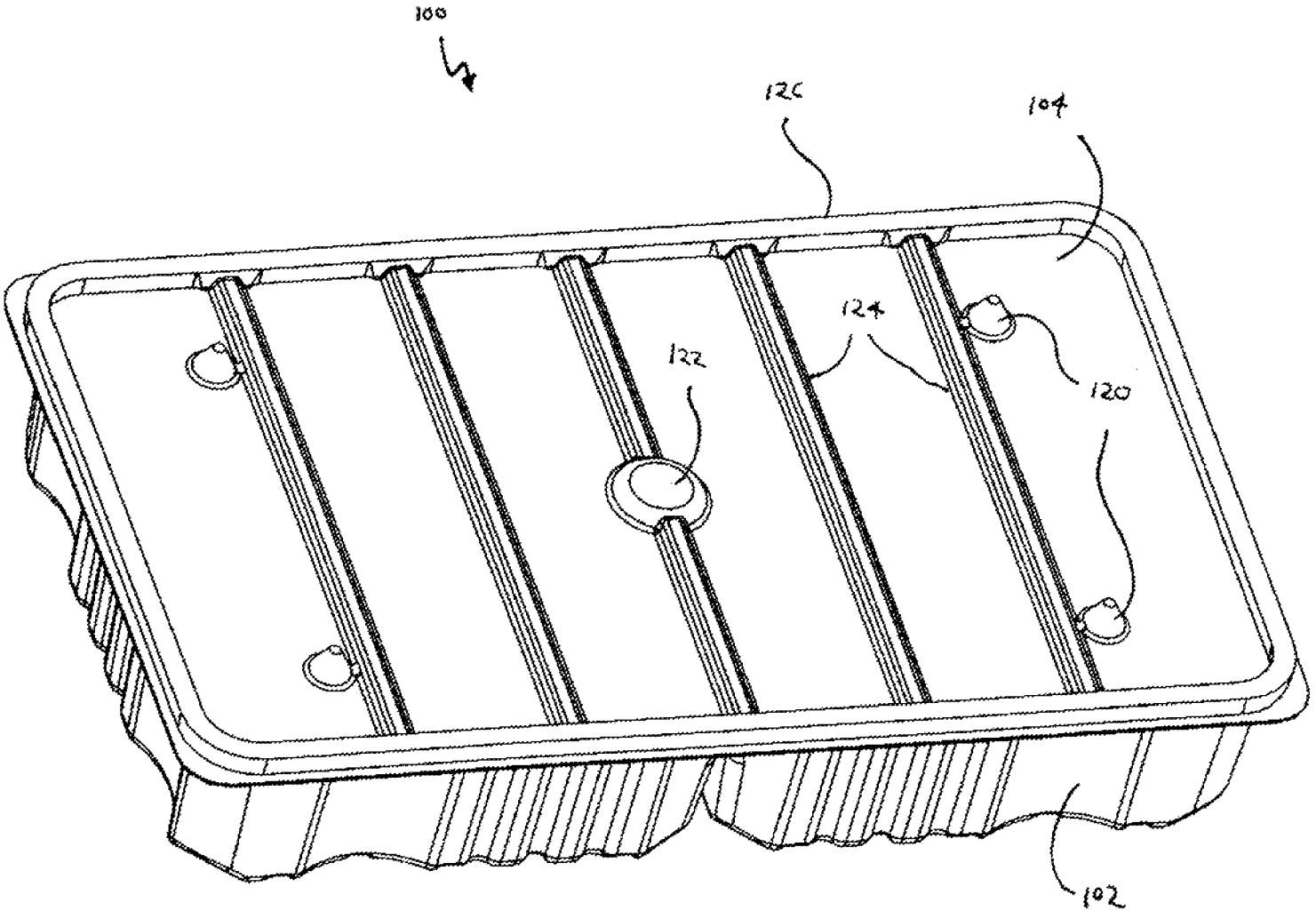
FIG. 1 is a perspective view of an embodiment of a container in accordance with the present invention.
Figure 2:
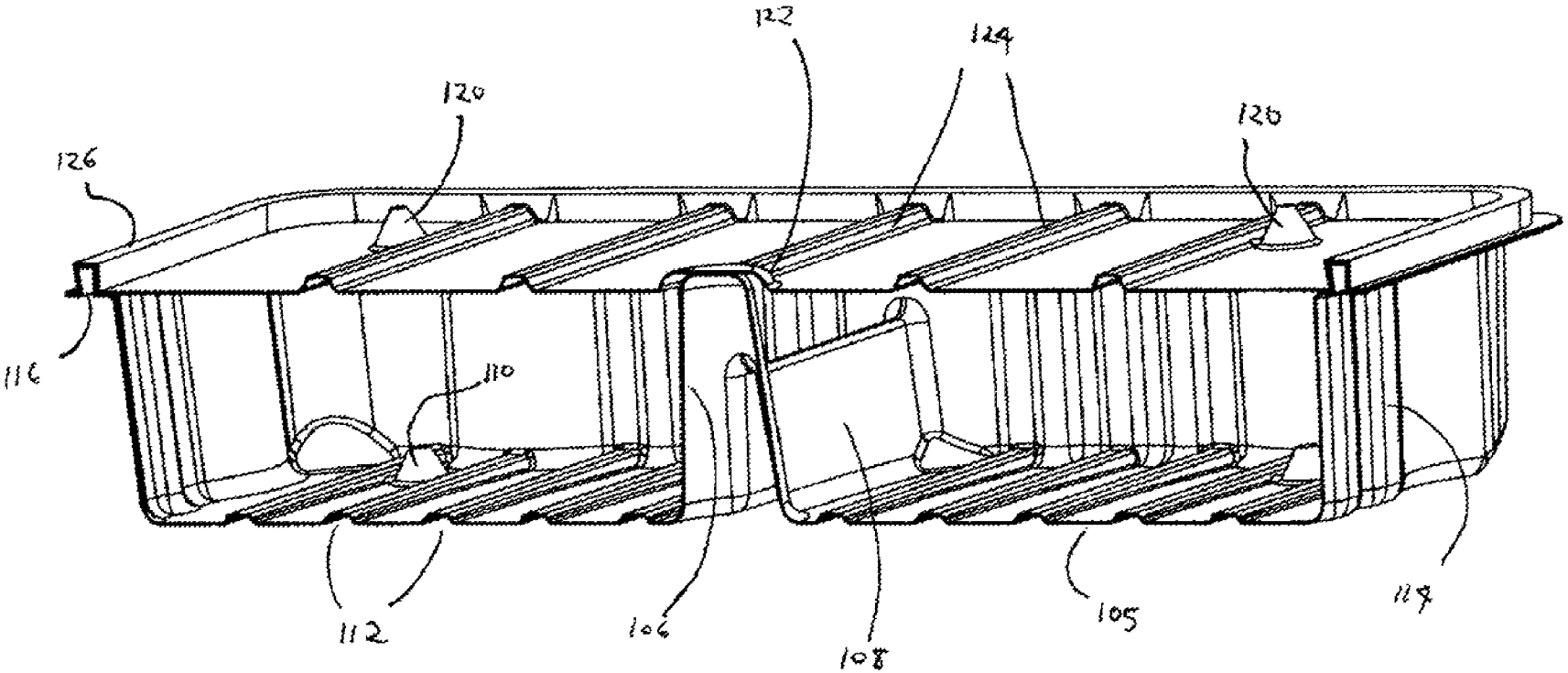
FIG. 2 is a cross-sectional perspective view of the container of FIG. 1.

Referring to FIGS. 1 and 2, an embodiment of a container 100 in accordance with the present invention is shown. The container 100 comprises a basket 102 defined at least partially by a base 105 and a sidewall 114 extending from the base 105 to a flange 116. As shown, the base 105 has a substantially rectangular footprint across the plane on which it rests. The sidewall 114 extending from the base 105 consequently has four faces. The base 105 is bifurcated by a support structure extending across a width of the container 100 and including a pillar 106 and a tie 108 having a first half extending from the pillar 106 to a face of the sidewall 114 and a second half extending from the pillar 106 to an opposite face of the sidewall 114. As can be seen more particularly in FIG. 2, the base 105 is slightly concave across the length of the container and is corrugated to include ridges 112 extending across the width of the container. The ridges 112 can serve one or more functions. For example, the ridges 112 can improve structural rigidity of the base; the ridges 112 can provide channels for draining fluids and/or holding contents above fluids. The ridges 112 can also function as registration features that are mateable with complementary features of a lid. In other embodiments, the base 105 need not include ridges. In still other embodiments, the base can be generally flat or alternatively can have some other shape relative to a plane on which the basket can rest, depending on a desired contact surface area, a desired flow of air and/or liquids along the base, etc. Optionally the base 105 can include one or more perforations, the one or more perforations permitting drainage, ventilation, ornamentation, or some other purpose.

As shown in FIG. 1A, the sidewall 114 has a simple draft that has a slight angle from perpendicular relative to a plane on which the container 100 sits. A draft can assist in ejection or removal of a basket from a mold. Further, the draft can sufficiently reduce a footprint of the base 105 such that the base 105 can be received on the lid of a second container without interference from a flange of the lid (if the flange is made to protrude above the resting surface of the lid). Alternatively, the sidewall 114 can include a compound draft from the flange 116 to the base 108. A compound draft includes two or more angle between the base 108 and the flange 116. The draft can be varied to suit manufacturing or to selectively adjust a volume of the basket. A sharper draft decreases basket volume, but can aid in manufacturing by easing ejection of the basket from a mold. In other embodiments, the sidewall 114 need not include a draft from the flange 116 to the base 105, or can include a compound draft including more than two angles. In still further embodiments, one face of the sidewall 114 can include no draft, or a draft having a different angle when compared with that of another face of the sidewall 114. One of ordinary skill in the art will appreciate the myriad different shapes including or excluding drafts with which the sidewall 114 extending from the base 105 to the flange 116 can be formed. Embodiments of baskets in accordance with the present invention are intended to be applied to all such shapes without necessary differentiation.

The base 105 of the basket 102 further includes four registration features 110 that are hollow frustums in shape. The registration features 110 extend into the basket at four positions along the base 105. The registrations features 110 are mateable with complementary registration features 120 protruding from a lid 104. The mated registration features 110/120 can resist relative shifting of two or more containers stacked together and/or can assist in directing placement of a container when stacking the container on another container. Other embodiments can include more or fewer registration features, and the registrations features can have a shape other than of a frustum. Further, the registration features need not necessarily be arranged in a symmetrical fashion and need not be arranged near the sidewalls. In still other embodiments, the base 102 and lid 104 need not include registration features. For example, in some embodiments ridges can be incorporated into the base as described above, with mating of the ridges with ridges of the lid providing registration.

As can be further seen, ribs are integrally formed within the faces of the sidewall 114 of the basket 102. The ribs can increase rigidity of the basket 102 to help prevent damage to goods held within the basket 102, and to resist collapse of the basket 102. Such baskets can be referred to as semi-smooth-walled baskets. Alternatively, embodiments of containers in accordance with the present invention can comprise baskets having smooth sidewalls which are generally featureless. Use of smooth sidewalls reduces the number of contactable edges, but can result in a sidewall having less rigidity (where the sidewall thickness is constant compared with a sidewall having ribs). Sidewall strength can be increased by increasing a thickness of the sidewalls.

Figure 3:
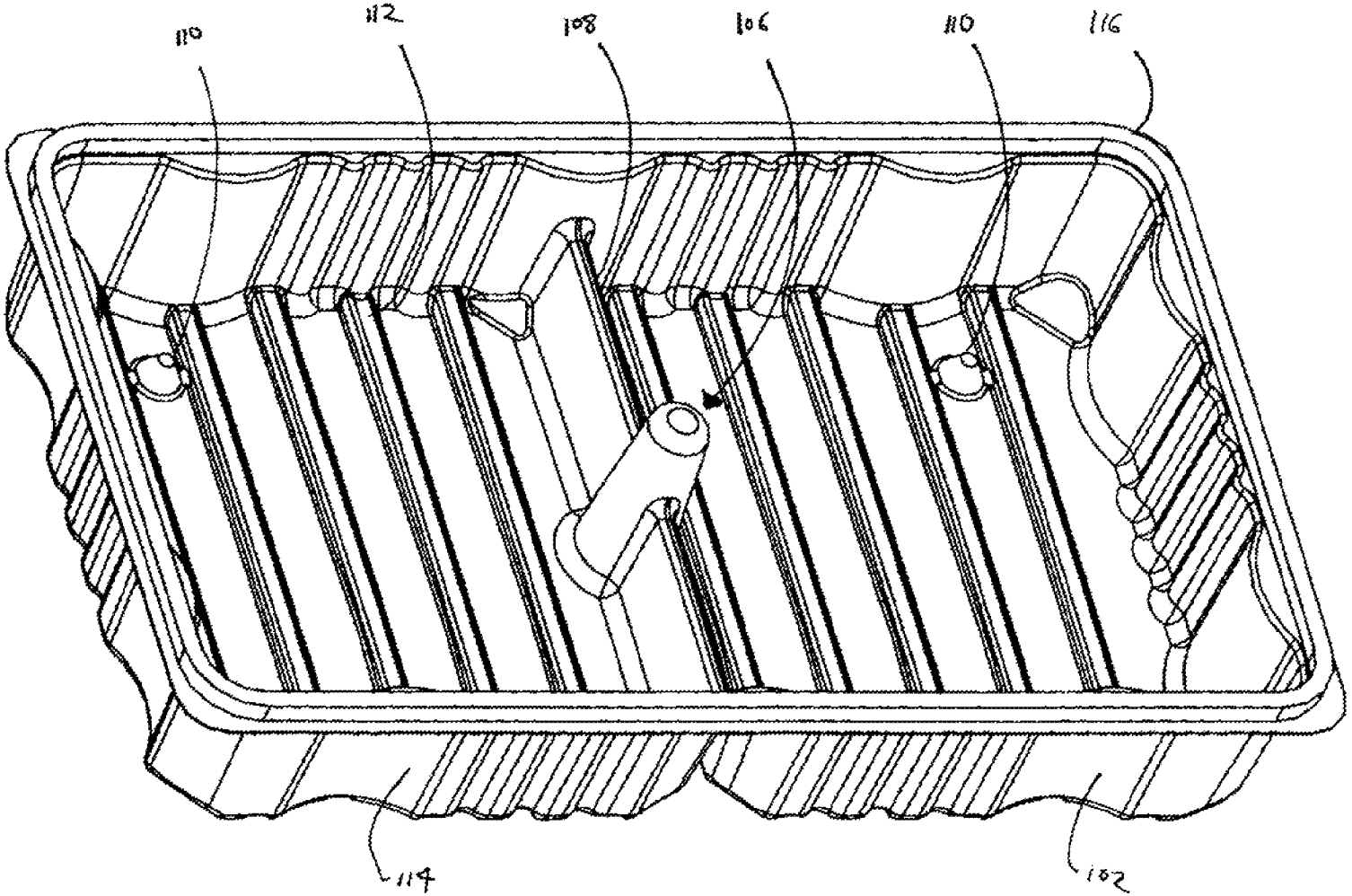
FIG. 3 is a perspective view of a basket of the container of FIG. 1.

Referring to FIGS. 2 and 3, as mentioned the base 105 is bifurcated by a support structure extending across a width of the container 100 and including a pillar 106 and a tie 108 having a first portion extending from the pillar 106 to a face of the sidewall 114 and a second portion extending from the pillar 106 to an opposite face of the sidewall 114. The pillar 106 has a shape of a frustum, with the diameter of the pillar 106 where the pillar meets the base 105 being larger than a diameter of the top of the pillar 106 contactable with the lid 104. In other embodiments, the pillar 106 can have some other shape, such as that of a pyramid or a cylinder. The pillar 106 provides support to the basket to resist compressive forces applied to the lid of the container when the lid is mated with a basket of a second container, or when some other mass is placed on the container. The pillar 106 is hollow to allow drainage of fluids and/or ventilation of air through the base 105. Further, a hollow pillar 106 will have a reduced weight over a solid pillar 106. However, it is contemplated that pillars comprising a solid shape are within the scope of the invention. Preferably, the support structure bifurcates the base; however, in other embodiments, the support structure can be off-center along the length or width of the basket. Embodiments in accordance with the present invention are not intended to be limited to those containers in which the support structure is symmetrically positioned. Further, embodiments in accordance with the present invention are not intended to be limited to those containers having a single support structure.

Additional containers or other objects stacked on top of a container can apply significant force to the lid and sidewalls that can urge the sidewalls to buckle. The tie 108 prevents the opposing faces of the sidewall with which the tie 108 is attached from spreading apart or separating. As mentioned above, the tie 108 is interrupted by the pillar 106, with which the tie 108 is integrally formed. The tie 108 is double walled and extends from the base so that a channel is formed between the divided portions of the base 105. The channel can be useful for draining fluids and/or allowing air to pass through the channel for ventilation. Alternatively, the tie 108 can be a solid structure, rather than a double-walled structure. In some embodiments, the tie 108 can include sufficient rigidity to support some compressive forces applied to the faces of the sidewall, helping protect fragile goods from compressive forces that impact the container when stacking, placing on pallets or otherwise interacting with the container. As shown, the tie 108 extends more than half of the height of the pillar 106. However, in other embodiments the tie 108 can have some other height. For example, the tie can extend from the base to the top of the pillar 106. The tie 108 can have a height sufficient to resist a desired magnitude of tensile forces without experiencing deformation. The height of the tie 108 can depend on material properties (e.g., the tensile strength of the material used), container size, the weight of the intended goods received within the container, etc. In other embodiments, the sidewalls can have a greater height so that the basket is deeper. Where the sidewalls have a greater height, the tie 108 may have a height roughly proportional, or the tie 108 may have a greater or smaller proportional height.

In a preferred embodiment, the container can be formed from PETE. However, in other embodiments the container can be formed from any resin known in the art for manufacturing plastic containers. For example, the container can be formed from any of high density polyethylene (HDPE), polyvinyl chloride (PVC), low density polyethylene (LDPE), polypropylene (PP), polystyrene (PS), and polycarbonate. Alternatively, the container can be formed from a material other than plastic resin, for example the container can be formed from paperboard or a composite material such as fiber-reinforced polymer (FRP) or glass-reinforced plastic (GRP).

Figure 4:
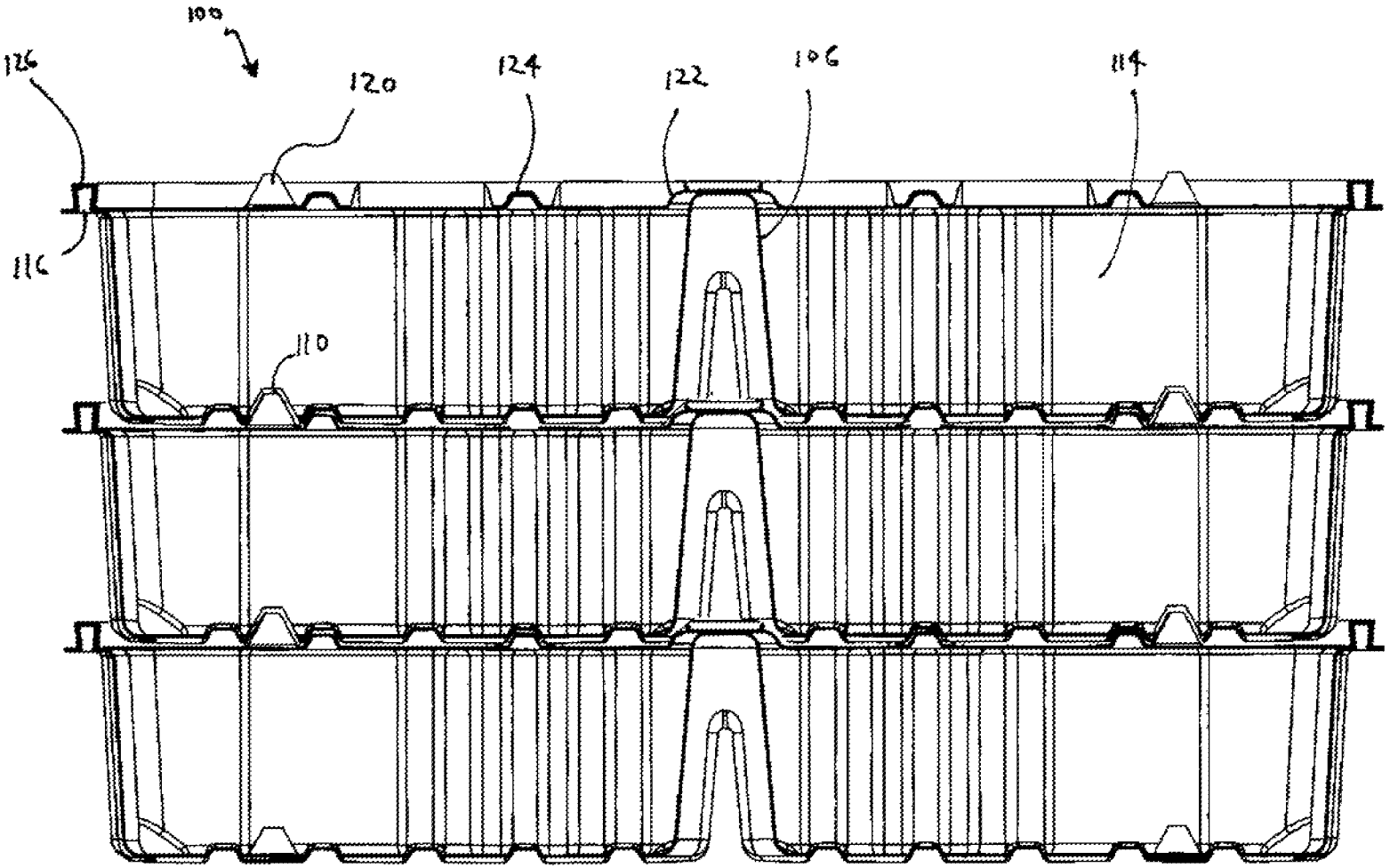
FIG. 4 is a side view of the container of FIG. 1 arranged in a stack of three containers.

The lid 104 of the container 100 can be seen in FIGS. 1, 2 and 4. The lid includes registration features 120 and ridges 124 that generally complement features of the base 105 so that a second container can be stacked on the lid. Because the features of the lid protrude outward of the basket, the lid can have fewer features than are included with the base 105. The periphery of the lid 104 includes a flange 126 that is mateable with a flange 116 of the basket 102 to provide an interference fit between the lid 104 and the basket 102. In other embodiments, the flange 126 of the lid 104 can have a geometry that locks the lid 104 in position to require actuation of a mechanism to release the lid 104 from the basket 102. For example, the flanges 116/126 can include a latch-and-catch type mechanism. The lid 104 includes a protrusion 122 that receives the pillar 106. The protrusion further fits within the channel formed by the pillar of a container stacked on top of the lid, as can be seen most clearly in FIG. 4. In other embodiments, a protrusion need not be included; rather the height of the pillar can be matched to be flush with the lid.

As will best be appreciated by referring to FIG. 4, the registration features and complementary features of the lid and the base allow the container to be aligned with other containers when stacked, thereby reducing shifting and improving compactness of a stack. In one example of an application for which an embodiment of the container can be used, containers can be filled with produce (e.g., lettuce), placed directly on a wooden pallet or stacked on top of one another, and the entire load including the pallet and the stacked containers can be shrink-wrapped for transport to a market or restaurant. The ridges 112 of the base can enable placement of the container on the wooden pallet, with the goods held within the container being raised for a desired purpose (e.g., drainage). This can reduce an amount of total packaging used for the application. Currently, such an application can include placing the produce in bags and/or smaller tubs that are then placed in corrugated cardboard containers. Additionally, where the material chosen for construction allows (e.g., PETE or HDPE), the container can be washable and reusable. Contrariwise, corrugated cardboard is generally not durable enough for repeated use.

The support structure of the containers can enable a large number of containers to be stacked on top of one another. For example, containers as shown in the embodiments of FIGS. 1-4 are contemplated to be stacked as high as from 15-18 containers. Increasing vertical stacking space by improving resistance to compressive forces can reduce a number of pallets and horizontal space required to deliver the goods without damage to the goods. Further, the size of the container is scalable to accommodate different types and quantities of goods held within the basket.

The foregoing description of the present invention has been presented for purposes of illustration and description. It is not intended to be exhaustive or to limit the invention to the precise forms disclosed. Many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

The invention claimed is:

1. A reusable system for transporting perishable goods comprising:

a first container including:

a basket with a base and a sidewall extending from the base to a flange;

a lid mateable with the flange of the basket, the lid including a registration feature; and a support structure including:

a pillar extending from the base; and a tie connected between the pillar and the sidewall;

wherein the tie is a double-walled structure that extends from the base toward the flange along at least a portion of a height of the sidewall and at least half of a height of the pillar;

wherein the tie includes a first portion connected between the pillar and a first face of the sidewall and a second portion wall connected between the pillar and a second face of the sidewall;

a second container stackable on the first container, the second container including:

a basket with a base and a sidewall extending from the base to a flange;

a lid mateable with the flange of the basket; and a support structure including:

a pillar extending from the base; and a tie connected between the pillar and the sidewall;

wherein the tie is a double-walled structure that extends from the base toward the flange along at least a portion of a height of the sidewall and at least half of a height of the pillar;

wherein the tie includes a first portion connected between the pillar and a first face of the sidewall and a second portion wall connected between the pillar and a second face of the sidewall;

wherein the second container base includes a registration feature that mates with the registration feature of the first container lid; and wherein the first container lid is supported at least partially by the pillar when the first container is stacked on the second container.

2. The reusable system of claim 1, wherein for each of the first and second containers, the pillar is integrally formed with the tie so that the double-walled structure of the first portion of the tie and the second portion of the tie interrupt and merge with a wall of the pillar; and further comprising a channel extending along a length of the support structure, the channel at least partially defined by the double-walled structure of the tie.

3. A stackable container for holding perishable goods comprising:

a basket including a base and a sidewall extending from the base to a flange;

a lid mateable with the basket by way of the flange; and a support structure including:

a pillar extending from the base; and a tie connected between the pillar and the sidewall;

wherein the tie is a double-walled structure that extends from the base toward the flange along at least a portion of a height of the sidewall and at least half of a height of the pillar;

wherein the tie includes a first portion connected between the pillar and a first face of the sidewall and a second portion wall connected between the pillar and a second face of the sidewall; and wherein the lid is supported at least partially by the pillar when a supportable mass is applied to the lid.

4. The container of claim 3, wherein:

the base is corrugated and includes ridges; and the lid is corrugated and includes one or more ridges that complement the ridges of the corrugated base such that the base is stackable with the lid so that the ridges of the lid and the basket are nested.

5. The container of claim 3, wherein:

the base includes registration features;

wherein the lid includes registration features that mate with the registration features of the base.

6. The container of claim 3, wherein the pillar is a frustum.

7. The container of claim 3, wherein the tie extends from the base toward the lid so that a gap exists between the tie and the lid when the lid is urged against the pillar by a supportable mass.

8. The container of claim 3, wherein the pillar is integrally formed with the tie so that the double-walled structure of the first portion of the tie and the second portion of the tie interrupt and merge with a wall of the pillar; and further comprising a channel extending along a length of the support structure, the channel at least partially defined by the double-walled structure of the tie.

9. A container for holding goods comprising:

a basket having a base and a sidewall;

wherein the basket includes a flange, and the sidewall of the basket extends from the base to the flange;

a lid mateable with the basket;

wherein the lid is mateable with the flange; and a support structure including:

a pillar extending between the base and the lid;

wherein the pillar extends from the base; and a tie connected between the pillar and the sidewall;

wherein the tie is a double-walled structure that extends from the base toward the flange along at least a portion of a height of the sidewall and at least half of a height of the pillar; and wherein the tie includes a first portion connected between the pillar and a first face of the sidewall and a second portion wall connected between the pillar and a second face of the sidewall.

10. The container of claim 9, wherein the base is corrugated.

11. The container of claim 10, wherein the corrugated base includes ridges; and the lid is corrugated and includes one or more ridges that complement the ridges of the corrugated base such that the base is stackable with the lid so that the ridges of the lid and the basket are nested.

12. The container of claim 9, wherein the base includes registration features.

13. The container of claim 12, wherein the lid includes registration features that mate with the registration features of the base.

14. The container of claim 12, wherein the sidewall includes a plurality of ribs.

15. The container of claim 9, wherein the pillar is a frustum.

16. The container of claim 9, wherein when the lid is mated with the flange, the tie extends from the base toward the lid so that a gap exists between the tie and the lid when the lid is urged against the pillar by a supportable mass.

17. The container of claim 9, wherein the pillar is integrally formed with the tie so that the double-walled structure of the first portion of the tie and the second portion of the tie interrupt and merge with a wall of the pillar; and further comprising a channel extending along a length of the support structure, the channel at least partially defined by the double-walled structure of the tie.

* * * * *

UNITED STATES PATENT AND TRADEMARK OFFICE

CERTIFICATE OF CORRECTION

PATENT NO. : 8,066,149 B2
APPLICATION NO. : 12/107453
DATED : November 29, 2011
INVENTOR(S) : Randall Glenn Strange and Richard L. Bontrager It is certified that error appears in the above-identified patent and that said Letters Patent is hereby corrected as shown below:

Title Pg, Item (73) Assignee:, delete "Packing Plus, LLC, La Mirada, CA (US)" and insert -- Packaging Plus, LLC, La Mirada, CA (US) --

Signed and Sealed this
Tenth Day of January, 2012

David J. Kappos

David J. Kappos
*Director of the United States Patent and Trademark Office*